United States Patent [19]

Taccetta et al.

[11] 4,002,869

[45] Jan. 11, 1977

[54] AUTOMATIC HIGH VOLTAGE GROUNDING DEVICE FOR PERSONNEL SAFETY

[75] Inventors: Philip Anthony Taccetta, Lanham; Robert Michael Novak, Baltimore, both of Md.

[73] Assignee: International Telephone and Telegraph Corporation, Nutley, N.J.

[22] Filed: May 8, 1975

[21] Appl. No.: 575,681

[52] U.S. Cl. ..... 200/61.7; 200/61.81; 174/51; 200/244

[51] Int. Cl.[2] ..... H01H 3/16

[58] Field of Search ..... 240/7.1 R; 312/223; 174/51, 52 R; 200/61.62, 61.7, 61.81, 61.83, 241, 244; 317/99, 103, 112, 118

[56] References Cited

UNITED STATES PATENTS

| | | | |
|---|---|---|---|
| 3,135,821 | 6/1964 | Lanham | 174/48 |
| 3,467,938 | 9/1969 | Jahr | 174/51 |
| 3,576,409 | 4/1971 | Fiddler | 200/61.7 |
| 3,655,926 | 4/1972 | Meermans | 200/61.62 |
| 3,858,019 | 12/1974 | Muri | 200/241 |
| 3,912,895 | 10/1975 | Plana | 200/241 |

*Primary Examiner*—Gerald P. Tolin
*Attorney, Agent, or Firm*—John T. O'Halloran; Alfred C. Hill

[57] ABSTRACT

The grounding device shorts high voltages within a cabinet to cabinet ground when a cabinet access door is opened. The device includes a base plate secured to the top of the cabinet adjacent the latch side of the access door. A high voltage terminal board having a plurality of high voltage terminals extending therethrough is secured to the base plate. A grounding plate is pivotably secured to the base plate. A plurality of spring finger contacts are secured to the grounding plate with each of the contacts being in a mating relationship with a different one of the plurality of terminals. An actuating lever has one end secured to the grounding plate and the other end engaging the inner surface of the access door to control the movement of the grounding plate to ground the terminals when the access door is opened and to remove ground from the terminals when the access door is closed. A counter weight is secured to the grounding plate to provide a positive movement for the grounding plate and a positive grounding contact between the terminals and the spring finger contacts when the access door is opened.

11 Claims, 2 Drawing Figures

AUTOMATIC HIGH VOLTAGE GROUNDING DEVICE FOR PERSONNEL SAFETY

BACKGROUND OF THE INVENTION

This invention relates to grounding devices and more particularly to an automatic high voltage grounding device to short high voltages within a cabinet to cabinet ground when a cabinet access door is opened.

During the design of a high power transmitter, it was recognized that a positive, highly visible, failsafe method of shorting the lethal high voltages within the cabinet to cabinet ground was required whenever the cabinet access door was opened, for the safety of maintenance personnel.

All known grounding devices to accomplish these requirements make use of a spring loaded push rod which actuates a mechanism that engages the high voltage contacts when the cabinet door is opened. By its nature, a push rod is a linear motion device which requires guides or bushings for alignment and is susceptible to binding. This problem of binding is further aggravated by the act that the portion of the access door operating on the actuating rod is not along the axis of the rod, but includes some force perpendicular to its axis.

The spring force to actuate the rod has its shortcomings also. Contact pressure is directly proportional to spring compressive force and is minimum when the access door is open (contacts shorted). Conversely, spring compressive force increases as the access door is closed which requires locating the device near a door latch or a relatively stiff section of the access door to ensure that the mechanism is fully disengaged from the high voltage contacts when the access door is closed.

In applications where the requirements of a positive, highly visible, failsafe method of shorting the lethal high voltages to ground are critical to the safety of maintenance personnel, the above-mentioned grounding technique is unacceptable.

SUMMARY OF THE INVENTION

An object of the present invention is to provide a grounding device that meets the above-mentioned requirements.

Another object of the present invention is to provide a grounding device which is mechanically simple, automatic and gravity actuated whenever a cabinet access door is opened.

Still another object of the present invention is to provide a grounding device which has no push rod, bushings or springs.

A feature of the present invention is the provision of an automatic high voltage grounding device to short high voltages within a cabinet to cabinet ground when a cabinet access door is opened comprising: a base plate secured to the cabinet adjacent the access door; a high voltage terminal board secured to the base plate, the terminal board having a plurality of high voltage terminals extending therethrough; a grounding plate pivotably secured to the base plate; a plurality of spring finger contacts secured to the grounding plate, each of the plurality of spring finger contacts being in a mating relationship with a different one of the plurality of terminals; an actuating lever having one end secured to the grounding plate and the other end engaging the inner surface of the access door to control the movement of the grounding plate to ground the plurality of terminals when the access door is opened and to remove ground from the plurality of terminals when the access door is closed; and a counter weight secured to the grounding plate to provide a positive movement for the grounding plate and a positive grounding contact between the plurality of terminals and the plurality of spring finger contacts when the access door is opened.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
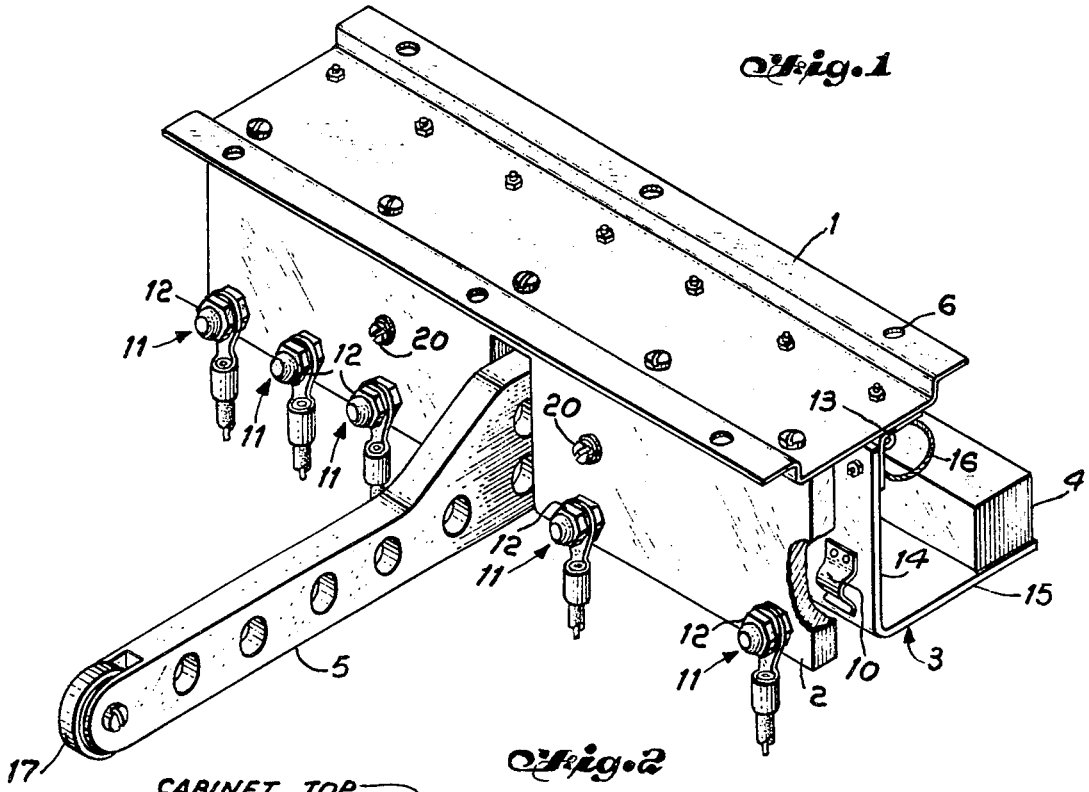
FIG. 1 is an isometric view of the grounding device in accordance with the principles of the present invention.
Figure 2:
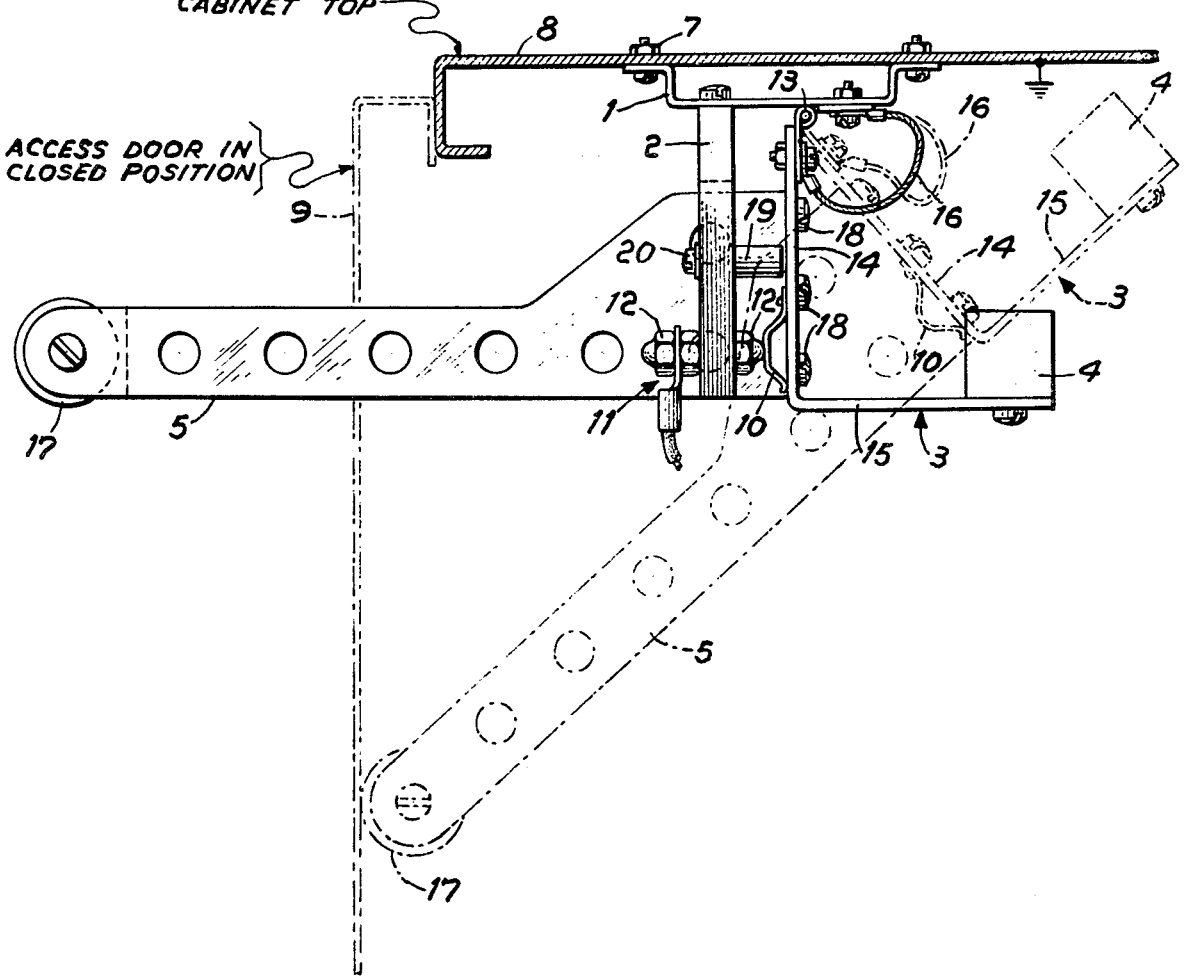
FIG. 2 is an end view of FIG. 1 in association with a cabinet containing high voltages and an access door for such a cabinet in accordance with the principles of the present invention.

In FIG. 2 the solid line illustration of the grounding device of FIG. 1 is the position that the grounding device of the present invention will assume when the access door is open, while the dotted line illustration of the grounding device of FIG. 1 illustrates the position assumed by the grounding device when the access door is closed.

Referring to FIGS. 1 and 2, the grounding device of the present invention includes a fixed base plate 1, a terminal board 2, a grounding plate 3 pivotably connected to base plate 1, counter weight 4 secured to grounding plate 3 and actuating lever 5.

Base plate 1 is fabricated from aluminum alloy and serves as a mounting base for various components of the grounding device and also has holes 6 and bolts 7 to secure the grounding device to the inside top of cabinet 8 near the latch side of access door 9. Base plate 1 is positioned relative to access door 9 such that when door 9 is fully closed, the spring finger contacts 10 will be separated from high voltage terminals 11 a sufficient distance to prevent flashover.

Terminal board 2, fabricated from glass reinforced epoxy, has threaded holes through which high voltage terminals 11 extend. Terminals 11 are spaced according to the voltage potential between them; the higher the potential, the greater the distance between terminals. Cap nuts 12 are installed on each end of terminals 11 to prevent corona discharge.

Movable and pivotable grounding plate 3 and counter weight 4 are fabricated from brass or steel and are attached to base plate 1 by means of metal piano hinge 13. Grounding plate 3 includes a first portion 14 parallel to terminal board 2 when access door 9 is open and a second portion 15 disposed at a right angle to first portion 14 with counter weight 4 being secured to second portion 15.

Flexible grounding straps 16 are installed between grounding plate 3 and base plate 1 to ensure electrical continuity between these plates.

Spring finger contacts 10, faricated from beryllium copper, are riveted to portion 14 of grounding plate 3 adjacent to each high voltage terminal 11. Spring finger contacts 10 mate with high voltage terminals 11 when the grounding device is in the closed position and, being flexible, these spring finger contacts ensure positive contact between grounding plate 3 and each of terminals 11.

At least one, but preferably a plurality of overtravel stops 19 are mounted on terminal board 2 by bolts 20 between portion 14 of grounding plate 3 and terminal board 2 to prevent over compression and possible permanent deformation of spring finger contacts 10.

Actuating lever 5 is fabricated from glass reinforced epoxy and has threaded holes in one end and a ball bearing roller 17 on the other end. The end with threaded holes is attached to portion 14 of grounding plate 3 by machine screws 18 and roller 17 attached to the other end of lever 5 contacts the access door 9. Roller 17 minimizes friction and ensures smooth operation as the access door is opened and closed.

As the access door is opened, roller 17 on the end of actuating lever 5 is forced to move with access door 9 by gravity acting on counter weight 4, bringing grounding plate 3 in position to contact high voltage terminals 11. The device is in the fully closed position (high voltage terminal shorted) when roller 17 loses contact with the door.

The grounding device illustrated and described above shorts to cabinet ground five voltages varying in potential from 1 KV (kilovolts) to 10 KV. However, any number of voltages of any potential can be shorted to ground using the concept of the present grounding device.

The grounding device of the present invention is intended to be used as a back-up or secondary safety to ensure personnel protection in the event the high voltage contactors fail to disengage or the bleeder circuits malfunction.

The high voltage grounding device as illustrated herein can be varied in size to accommodate higher or lower voltages or to include more or fewer terminals. Also, counter weight 4 can be made lighter or heavier to provide the proper contact pressure to match the size of the device or the number of terminals used.

It is proposed that one high voltage grounding device as disclosed herein be installed at each access door of a cabinet containing high voltages.

Some of the advantages of the grounding device of this invention relative to the above-mentioned prior art grounding devices will now be mentioned.

The grounding device illustrated and described herein has no push rods, no guides, no bushings and no springs, thereby eliminating alignment and/or binding problems and the possibility of spring breakage which would render the grounding device inoperative and unsafe.

The design of actuating lever 5 is such that the force required to overcome the weight of counter weight 4, which is secured to grounding plate 3, is maximum when access door 9 is open (contacts shorted) providing maximum contact pressure and maximum personnel safety. Conversely, the force required to overcome the weight of counter weight 4 decreases as access door 9 is closed due to an increase in the effective lever arm, thereby minimizing the force required to hold the grounding device in the open position. As access door 9 is opened, the angular velocity of actuating lever 5 and grounding plate 3 increases as the grounding device nears the end of its travel and tends to snap into position, thereby ensuring positive contact. Due to the position of actuating lever 5 adjacent the latch side of access door 9, an unsafe condition is easily recognized.

While we have described above the principles of our invention in connection with specific apparatus it is to be clearly understood that this description is made only by way of example and not as a limitation to the scope of our invention as set forth in the objects thereof and in the accompanying claims.

We claim:

1. An automatic high voltage grounding device to short high voltages within a cabinet to cabinet ground when a cabinet access door having a latch side is opened comprising:
   - a base plate secured to said cabinet adjacent said access door;
   - a high voltage terminal board secured to said base plate, said terminal board having a plurality of high voltage terminals extending therethrough;
   - a grounding plate pivotably secured to said base plate;
   - a plurality of spring finger contacts secured to said grounding plate, each of said plurality of spring finger contacts contacting a different one of said plurality of terminals when said access door is fully open;
   - an actuating lever having one end secured to said grounding plate and the other end engaging the inner surface of said access door to control the movement of said grounding plate to ground said plurality of terminals when said access door is fully opened and to remove ground from said plurality of terminals when said access door is closed, said lever losing contact with said access door when said access door is fully opened to ground said plurality of terminals; and
   - a counter weight secured to said grounding plate and providing a positive movement of said grounding plate and a positive grounding contact between said plurality of terminals and said plurality of spring finger contacts when said access door is fully opened to protect personnel from said high voltages on said plurality of terminals.

2. A grounding device according to claim 1, wherein said base plate is bolted to the inside top of said cabinet adjacent said latch side of said access door.

3. A grounding device according to claim 1, wherein said grounding plate is hinged to said base plate by a piano hinge.

4. A grounding device according to claim 1, wherein said one end of said actuating lever is bolted to said grounding plate, and
   said other end of said actuating lever includes
   - a ball bearing roller secured thereto for engaging said access door.

5. A grounding device according to claim 1, wherein said grounding plate includes
   - a first portion parallel to said terminal board when said access door is open, said first portion having secured thereto said plurality of spring finger contacts, and
   - a second portion disposed at a right angle to said first portion, said counter weight being secured to said second portion.

6. A grounding device according to claim 1, further including
   - a grounding strap connected between said grounding plate and said base plate.

7. A grounding device according to claim 1, further including at least one overtravel stop secured to said terminal board and extending toward said grounding plate.

8. A grounding device according to claim 1, wherein said base plate is bolted to the inside top of said cabinet adjacent said latch side of said access door, said grounding plate includes a first portion parallel to said terminal board when said access door is open, said first portion having secured thereto said plurality of spring finger contacts, a second portion disposed at a right angle to said first portion, said counter weight being secured to said second portion, and a piano hinge secured to said first portion and said base plate, said one end of said actuating lever is bolted to said grounding plate, and said other end of said actuating lever includes a ball bearing roller secured thereto for engaging said access door, and further including a grounding strap connected between said grounding plate and said base plate; and at least one overtravel stop secured to said terminal board and extending toward said grounding plate.

9. A grounding device according to claim 1, wherein said grounding plate includes a first portion parallel to said terminal board when said access door is open, said first portion having secured thereto said plurality of spring finger contacts, a second portion disposed at a right angle to said first portion, said counter weight being secured to said second portion, and a piano hinge secured to said first portion and said base plate.

10. A grounding device according to claim 1, further including a grounding strap connected between said grounding plate and said base plate; and at least one overtravel stop secured to said terminal board and extending toward said grounding plate.

11. A grounding device according to claim 1, wherein said base plate is bolted to the inside top of said cabinet adjacent said latch side of said access door, said one end of said actuating lever is bolted to said grounding plate, and said other end of said actuating lever includes a ball bearing roller secured thereto for engaging said access door.

* * * * *